US009625124B2

(12) United States Patent
Sun et al.

(10) Patent No.: US 9,625,124 B2
(45) Date of Patent: Apr. 18, 2017

(54) LAMP STRUCTURE OF ADAPTIVE STREETLIGHT

(71) Applicant: National Central University, Taoyuan (TW)

(72) Inventors: Ching-Cherng Sun, Taoyuan (TW); Tsung-Hsun Yang, Taoyuan (TW); Xuan-Hao Lee, Taoyuan (TW); Chen-Hao Lee, Taoyuan (TW)

(73) Assignee: National Central University, Taoyuan (TW)

( * ) Notice: Subject to any disclaimer, the term of this patent is extended or adjusted under 35 U.S.C. 154(b) by 0 days.

(21) Appl. No.: 14/814,724

(22) Filed: Jul. 31, 2015

(65) Prior Publication Data

US 2016/0369978 A1 Dec. 22, 2016

(30) Foreign Application Priority Data

Jun. 17, 2015 (TW) ..... 104119637 A

(51) Int. Cl.

| | |
|---|---|
| ***F21V 14/00*** | (2006.01) |
| ***F21S 8/08*** | (2006.01) |
| ***F21V 3/04*** | (2006.01) |
| ***F21V 5/00*** | (2015.01) |

(52) U.S. Cl.
CPC ..... *F21V 14/006* (2013.01); *F21S 8/086* (2013.01); *F21V 3/049* (2013.01); *F21V 5/004* (2013.01)

(58) Field of Classification Search
CPC ..... F21V 14/006; F21V 3/049; F21V 5/004; F21S 8/086
See application file for complete search history.

(56) References Cited

U.S. PATENT DOCUMENTS 4,733,335 A * 3/1988 Serizawa ..... B60Q 1/302 362/373

* cited by examiner

*Primary Examiner* — Thomas M Sember
(74) *Attorney, Agent, or Firm* — Juan Carlos A. Marquez; Marquez IP Law Office, PLLC

(57) ABSTRACT

A lamp structure of an adaptive streetlight includes a housing, a plurality of light sources, and a surface-structured diffusion plate. The surface-structured diffusion plate enables the lamp structure to provide a light pattern conforming to the curvature of the road to be illuminated or other sites of application, thus reducing not only the number of lamps or streetlights required for a curvy road section, but also the associated installation cost and power consumption. The lamp structure can enhance road users' safety and the safety of our daily lives by increasing the illuminance on a curvy road and other sites of application that have special requirements.

9 Claims, 16 Drawing Sheets

LAMP STRUCTURE OF ADAPTIVE STREETLIGHT

BACKGROUND OF THE INVENTION

1. Technical Field

The present invention relates to a lamp structure and more particularly to a lamp structure which is applicable to an adaptive streetlight and which has a surface-structured diffusion plate in order to provide a particular light pattern that matches the curvature of the road section to be illuminated.

2. Description of Related Art

Nowadays, with the expansion of transportation networks, the quality of road lighting determines to a large extent whether the roads being illuminated are safe. Road lighting, therefore, plays an important role in the safety of life and property of all road users.

The conventional streetlights, be they equipped with the traditional light bulbs or the more energy-saving LEDs, cannot change their light patterns according to road curvatures. While the resulting problem of insufficient lighting can be solved by installing more streetlights, a significant increase in cost and energy consumption ensues.

FIG. 7A is a schematic top view of a road illuminated by a plurality of conventional streetlights 500 or commercially available streetlights. Typically, the light pattern 510 of the light projected on the ground by a conventional streetlight 500 is localized and lies only around the streetlight such that the road surface is poorly lit. Aside from an uneven distribution of illuminance over the road surface, part of the optical energy is cast outside the road. If the road has a steep slope, the light may even strike the road users' eyes, which causes glare and a considerable waste of energy.

To achieve the road surface illuminance required by law, it is common practice to increase the working power or number of the conventional streetlights 500, leading, however, to excessive power consumption or a wasteful use of resources.

Moreover, some conventional streetlights 500 or commercially available streetlights have a conventional diffusion plate, which is generally made by incorporating micro particles into a substrate, coating a substrate with micro particles, or providing a substrate with a diffusive surface structure.

Mixing micro particles into a substrate does increase diffusivity effectively but reduces permeability of light. Coating a substrate with micro particles tends to have a low yield, and the coated substrate is prone to damage and diffuses light in directions that cannot be controlled.

A diffusive surface structure, on the other hand, is typically made by grinding a substrate's surface with micro particles so that the surface has an irregular roughened texture. A notable example of products with a diffusive surface structure is ground glass. While such surface structures are diffusive to a certain degree, the directions of light diffusion remain uncontrollable.

In view of the above, it is an important issue for the lighting industry or even the entire transportation industry to overcome the aforesaid drawbacks of the conventional streetlights 500 and to provide a lamp structure which meets the requirements of highly uniform light distribution, high diffusivity, and high permeability of light, and which therefore contributes to enhancing the quality of life of the general public. To this end, it is most desirable that a highly efficient refractive optical element (ROE), or more particularly a surface-structured diffusion plate, can be made by forming a micro lens array (i.e., surface structure) on the surface of a substrate.

BRIEF SUMMARY OF THE INVENTION

The present invention relates to a lamp structure of an adaptive streetlight, wherein the lamp structure includes a housing, a plurality of light sources, and a surface-structured diffusion plate. The surface-structured diffusion plate, or called surface-structured diffuser (SSD), enables the lamp structure to provide a light pattern conforming to the curvature of the road to be illuminated or other sites of application, thus reducing not only the number of lamps or streetlights required for a curvy road section, but also the associated installation cost and power consumption. More importantly, the present invention enhances road users' safety and the safety of our daily lives by increasing the illuminance on a curvy road and other sites of application that have special requirements.

More specifically, the present invention provides a lamp structure of an adaptive streetlight, wherein the lamp structure includes: a housing with a bottom surface and an opening; a plurality of light sources fixedly provided on the bottom surface of the housing; and a surface-structured diffusion plate, which is a light-permeable plate connected to the opening and provided with a plurality of microstructures, each microstructure having a curved or parabolic surface as a light-receiving surface.

Implementation of the present invention at least produces the following advantageous effects:

1. The cost of implementation is low because no complicated manufacturing process or equipment is required.
2. The number of lamps or streetlights required for a curvy road section can be reduced to cut installation cost and power consumption.
3. The illumination of a curvy road section can be enhanced to increase drivers' and other road users' safety.
4. Different light patterns can be produced by only replacing different surface-structured diffusion plates according to practical needs.

DETAILED DESCRIPTION OF THE INVENTION

Figure 1:
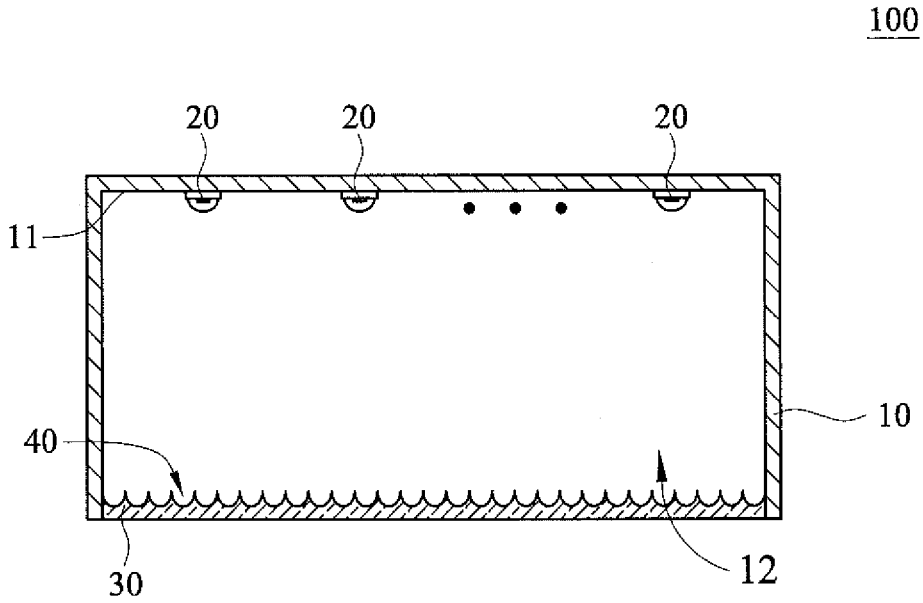
FIG. 1 is a schematic sectional view of the lamp structure of an adaptive streetlight in an embodiment of the present invention.

Referring to FIG. 1, the lamp structure 100 of an adaptive streetlight in an embodiment of the present invention includes a housing 10, a plurality of light sources 20, and a surface-structured diffusion plate 30. The surface-structured diffusion plate 30 has a light-receiving surface provided with a plurality of microstructures 40.

As shown in FIG. 1, the housing 10 serves as the lampshade of the lamp structure 100 and has a bottom surface 11 and an opening 12 located opposite the bottom surface 11. There is no limitation on the material of the housing 10. Generally speaking, the housing 10 is made of a lightweight, sturdy, and heat-resistant material.

The inner wall of the housing 10 can be formed of a high-reflectivity material for reflecting light, or more particularly for reflecting backward light, generated by the surface-structured diffusion plate 30 reflecting light toward the inner wall of the housing 10, via a photon recycling mechanism so that the backward light is projected back toward the surface-structured diffusion plate 30 and becomes forward light. The goal is to increase light output and enhance the optical efficiency of the entire lamp structure 100.

As shown in FIG. 1, the light sources 20 are fixedly provided on the bottom surface 11 of the housing 10. Each light source 20 can be an LED (light-emitting diode) light source 20 composed of at least one LED, or an OLED (organic light-emitting diode) light source 20 composed of at least one OLED.

With continued reference to FIG. 1, the surface-structured diffusion plate 30 is connected to the opening 12 of the housing 10 and is a light-permeable plate. As previously mentioned, the surface-structured diffusion plate 30 has a light-receiving surface provided with a plurality of microstructures 40. Each microstructure 40 is a curved surface or a parabolic surface. The microstructures 40 are provided on the surface-structured diffusion plate 30 in a concave manner, in a protruding manner, or partly in a concave manner and partly in a protruding manner.

Figure 4:
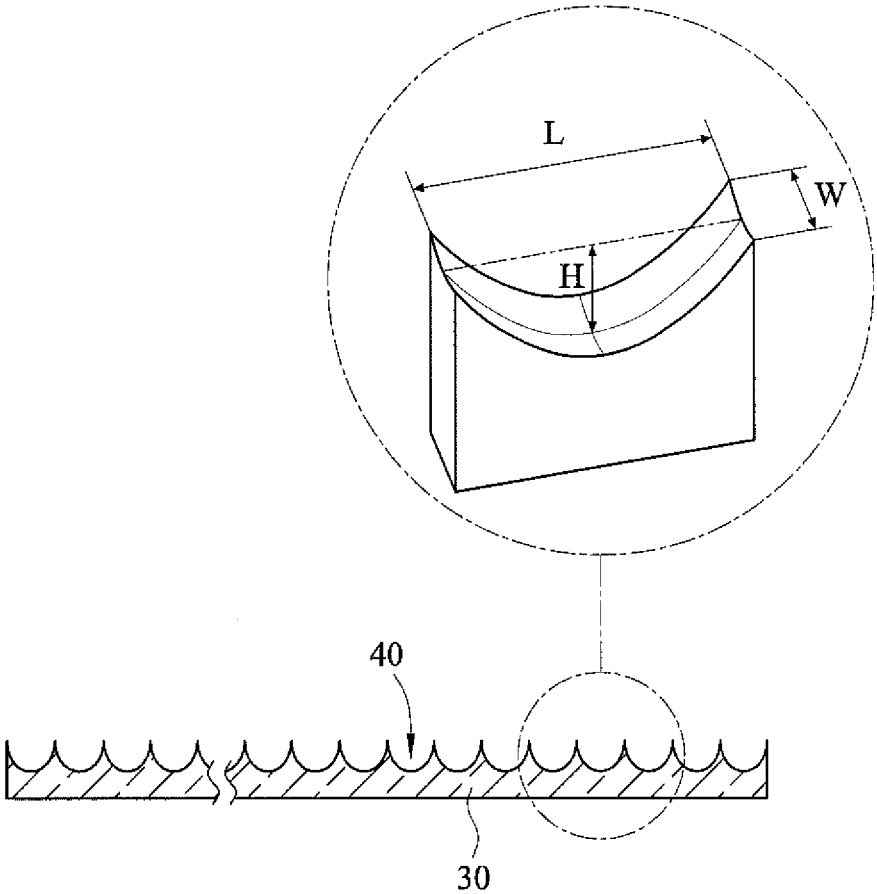
FIG. 4 schematically shows the surface-structured diffusion plate in an embodiment of the present invention.

Referring to FIG. 4 in conjunction with FIG. 1, each curved- or parabolic-surface microstructure 40 has a length L, a width W, and a depth H.

Figure 5A:
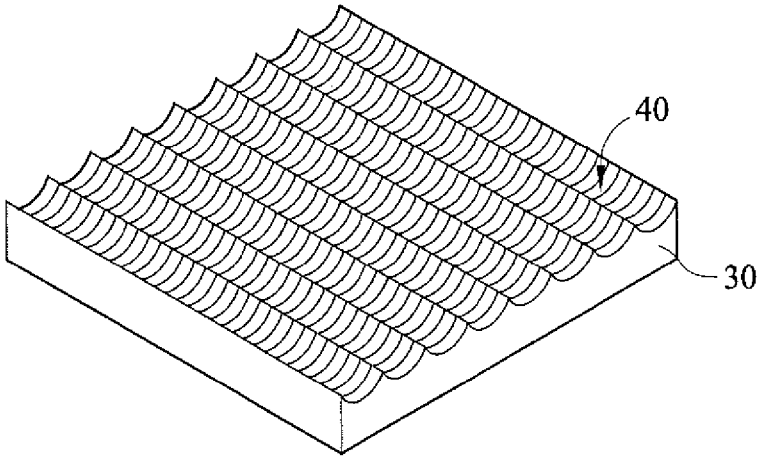
FIG. 5A is a schematic perspective view of the surface-structured diffusion plate in an embodiment of the present invention.
Figure 6A:
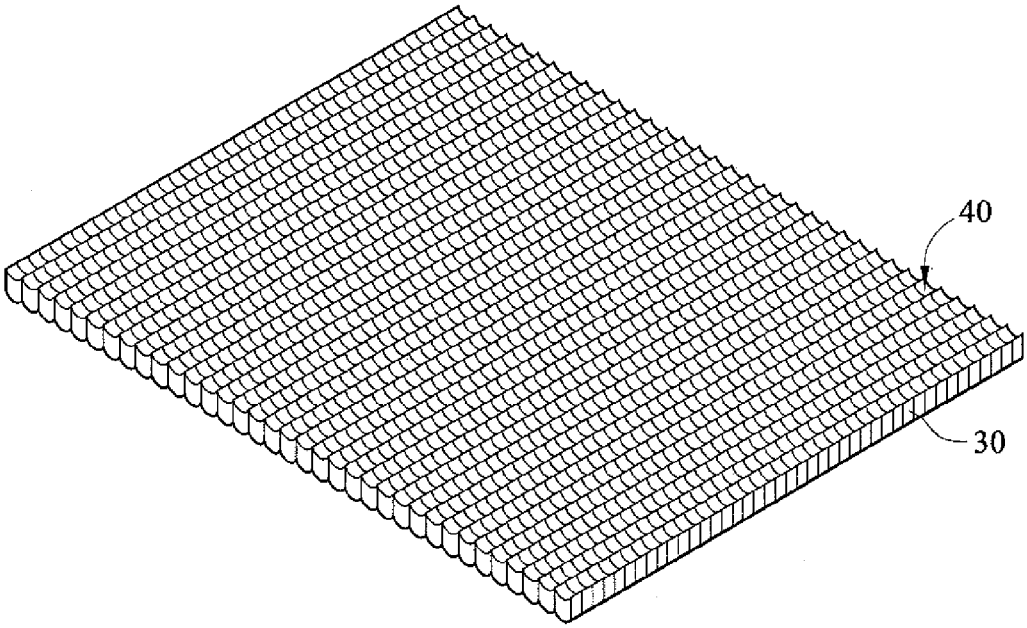
FIG. 6A is a schematic perspective view of the surface-structured diffusion plate in another embodiment of the present invention.

The surface-structured diffusion plate 30 may also be composed of a plurality of micro lenses arranged in an array, as shown in FIG. 5A and FIG. 6A.

Referring to FIG. 1, FIG. 4, FIG. 5A, and FIG. 6A, whether the microstructures 40 of the surface-structured diffusion plate 30 are curved surfaces, parabolic surfaces, or micro lenses, a dimension (the length L or the width W) of each microstructure 40 can be so chosen that it is greater than ten times the wavelength of the light emitted by each light source 20.

Figure 2:
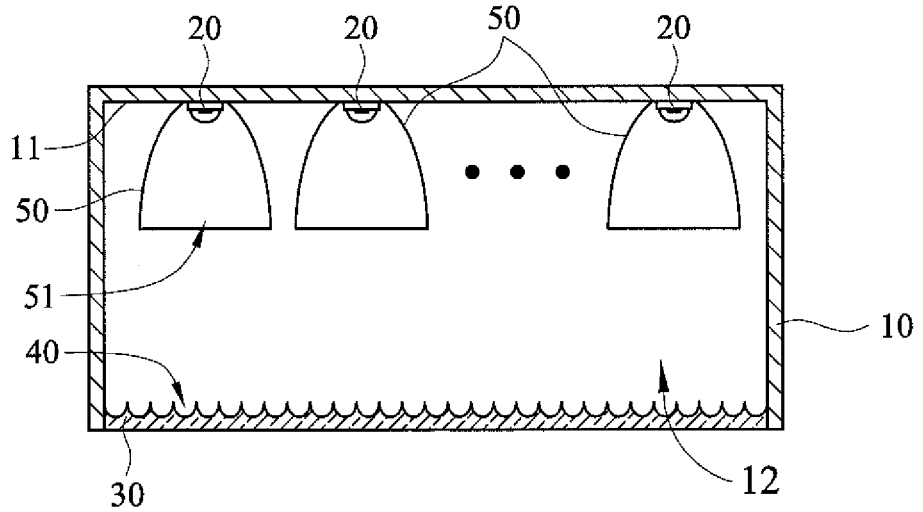
FIG. 2 is a schematic sectional view of the lamp structure of an adaptive streetlight in another embodiment of the present invention, wherein the lamp structure has light-condensing devices.

Referring now to FIG. 2, each light source 20 of the lamp structure 100 may be further connected with a light-condensing device 50. Each light-condensing device 50 has a projection opening 51 corresponding to the opening 12 of the housing 10.

Each light-condensing device 50 serves mainly to collect the light emitted by the corresponding light source 20 and project the light through the projection opening 51 of the light-condensing device 50 toward the opening 12 of the housing 10. After light pattern modulation by the surface-structured diffusion plate 30, the light is eventually output from the opening 12 of the housing 10.

Figure 3A:
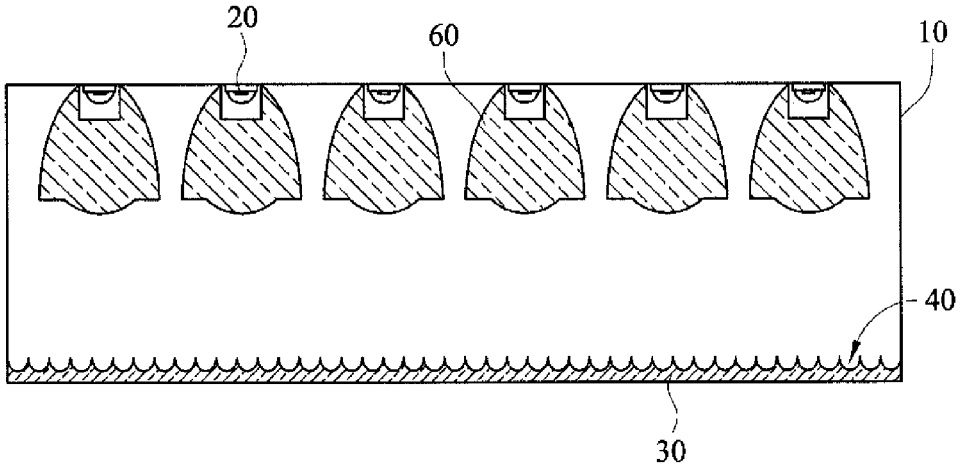
FIG. 3A is a schematic view of an embodiment of the present invention, wherein the light-condensing devices are condenser lenses.
Figure 3B:
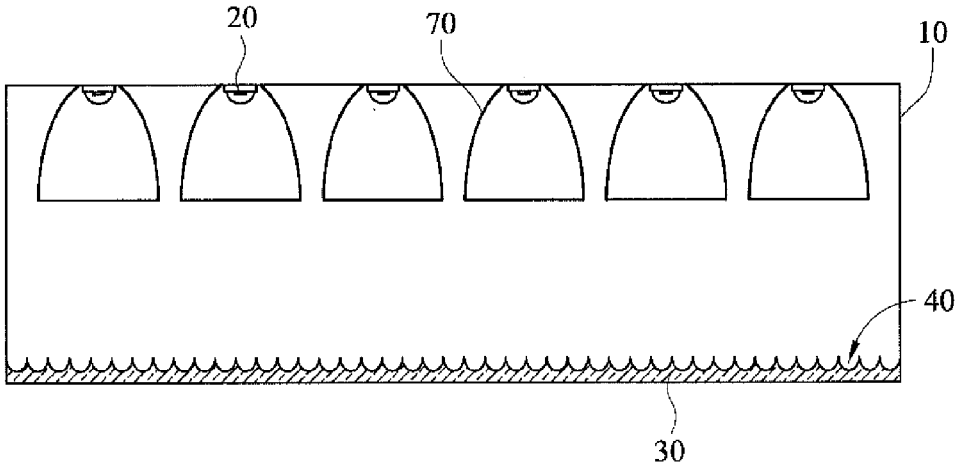
FIG. 3B is a schematic view of an embodiment of the present invention, wherein the light-condensing devices are reflectors.

As shown in FIG. 3A and FIG. 3B, the light-condensing devices 50 can be condenser lenses 60 (e.g., total internal reflection lenses, or TIR lenses) or reflectors 70, provided that the light-condensing devices 50 can each reflect and collect the light emitted by the corresponding light source 20 and project the light out of the projection opening 51 of the light-condensing device 50.

Figure 5B:
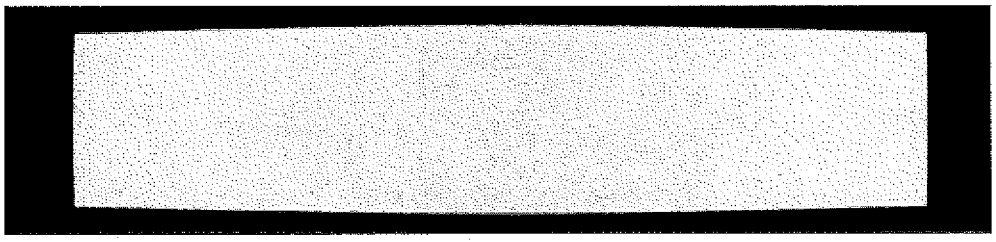
FIG. 5B schematically shows the particular light pattern produced by the surface-structured diffusion plate in FIG. 5A.

FIG. 5A schematically shows the surface-structured diffusion plate 30 in an embodiment of the present invention in perspective view. A lamp structure 100 with the surface-structured diffusion plate 30 in FIG. 5A produces a rectangular light pattern as shown in FIG. 5B.

Figure 6B:
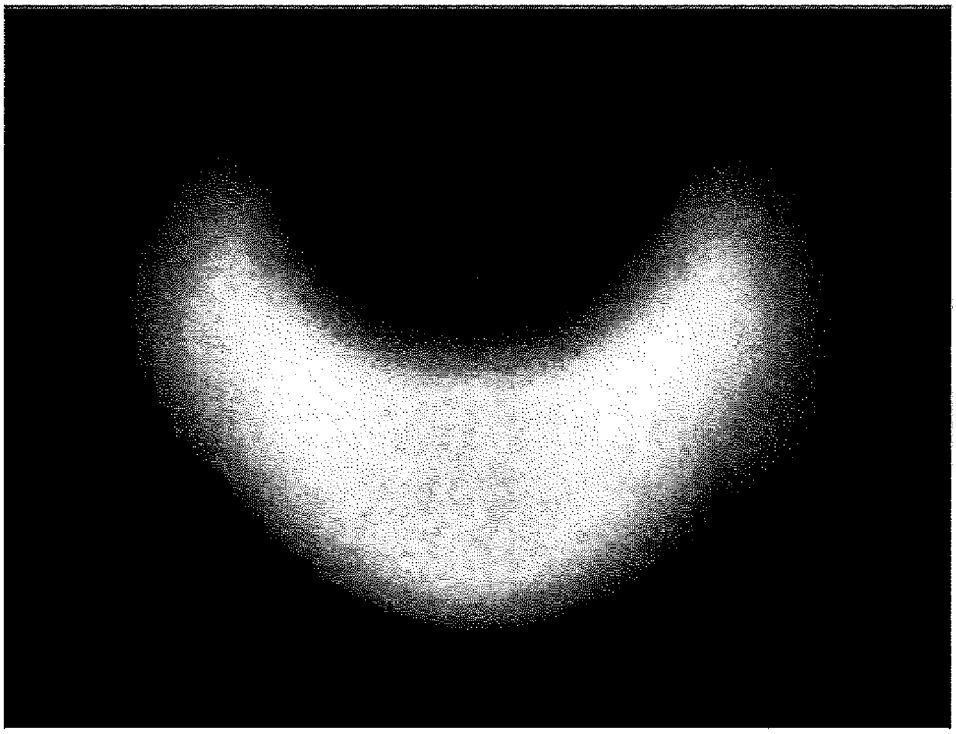
FIG. 6B schematically shows the particular light pattern produced by the surface-structured diffusion plate in FIG. 6A.

FIG. 6A shows the surface-structured diffusion plate 30 in another embodiment of the present invention. A lamp structure 100 with the surface-structured diffusion plate 30 in FIG. 6A produces a curved light pattern as shown in FIG. 6B.

As shown in FIG. 1 through FIG. 6B and FIG. 7B, the light emitted by each light source 20 on the bottom surface 11 of the housing 10 is modulated by the corresponding light-condensing device 50 in terms of light propagation direction so that the light projected from the projection opening 51 of the light-condensing device 50 propagates at a small angle of divergence. This light with a small divergence angle passes through the surface-structured diffusion plate 30, is modulated by and subjected to the beam shaping effect of the specially designed microstructures 40 on the surface of the surface-structured diffusion plate 30, and thus forms a particular light pattern 200 conforming to the shape of the road to be illuminated. The user may replace an existing surface-structured diffusion plate 30 with one of a different configuration in order to obtain the desired light pattern 200 and serve the adaptive function of an adaptive streetlight.

Figure 7A:
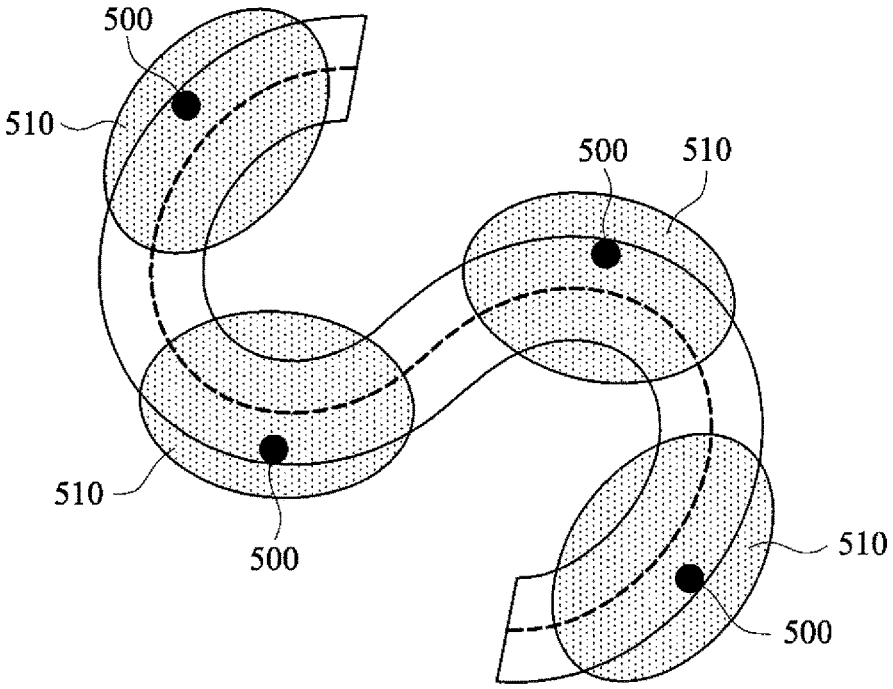
FIG. 7A (Prior Art)
FIG. 7A schematically shows the light patterns projected on a curvy road by conventional streetlights.
Figure 7B:
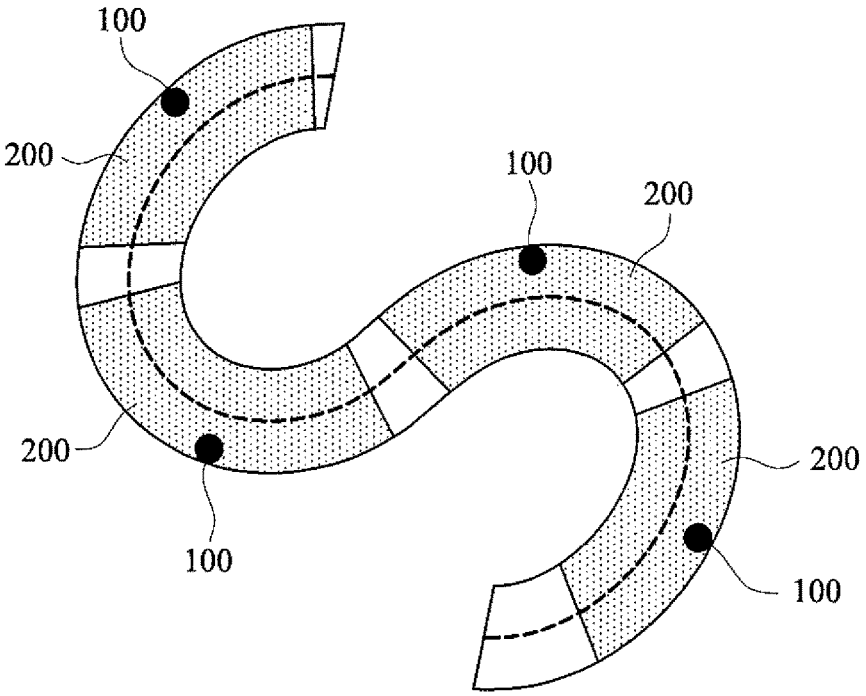
FIG. 7B schematically shows the particular light patterns projected on a curvy road by lamp structures in an embodiment of the present invention.
Figure 8A:
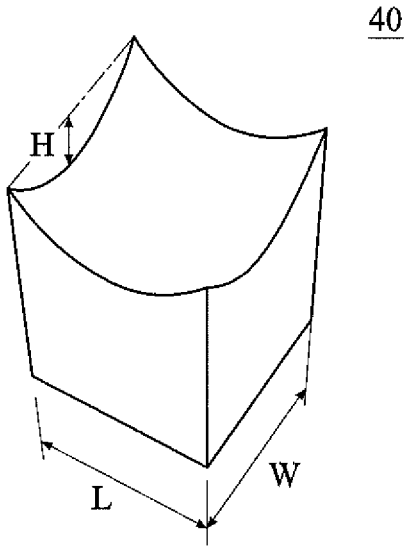
FIG. 8A shows the dimensions of a microstructure in an embodiment of the present invention.
Figure 8B:
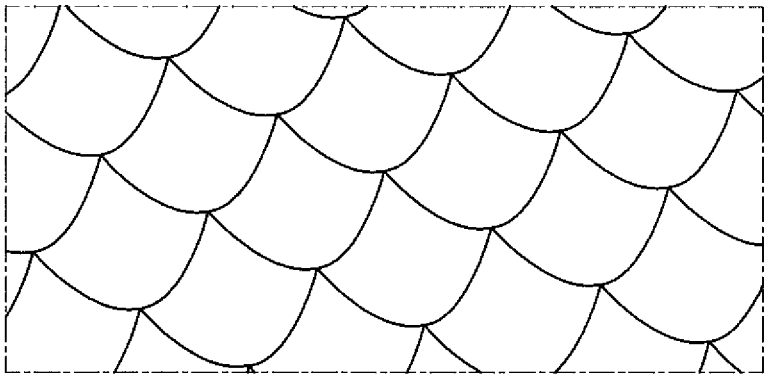
FIG. 8B schematically shows a surface-structured diffusion plate composed of a plurality of microstructures as depicted in FIG. 8A.
Figure 8C:
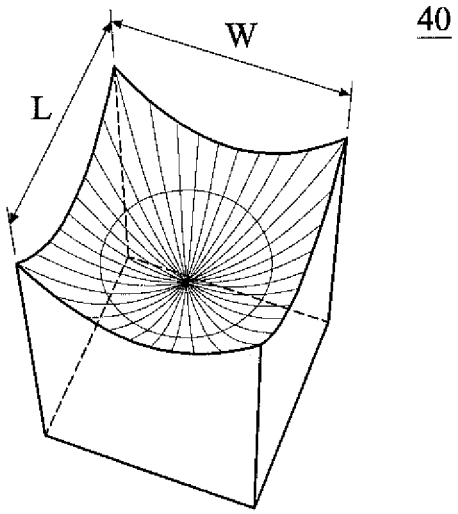
FIG. 8C is a schematic perspective view of the microstructure in FIG. 8A.
Figure 8D:
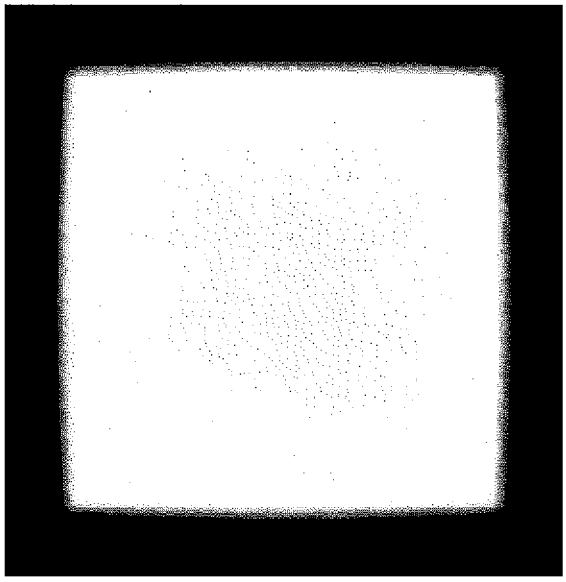
FIG. 8D schematically shows the particular light pattern produced by the surface-structured diffusion plate in FIG. 8B.
Figure 9A:
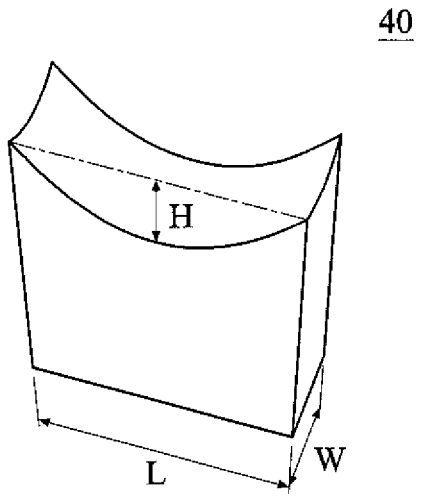
FIG. 9A schematically shows a microstructure in another embodiment of the present invention.
Figure 9B:
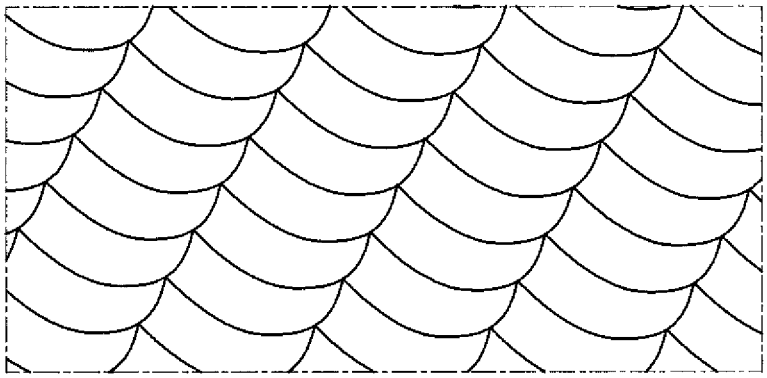
FIG. 9B schematically shows a surface-structured diffusion plate composed of a plurality of microstructures as depicted in FIG. 9A.
Figure 9C:
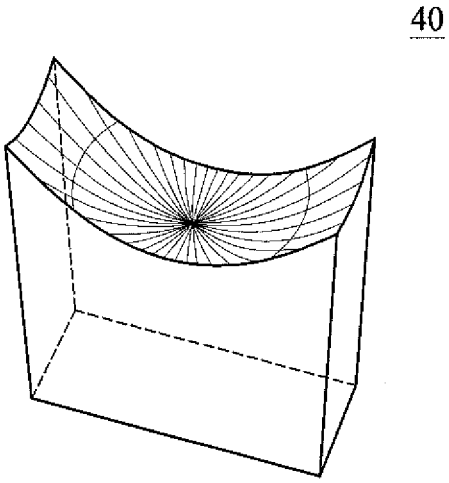
FIG. 9C is a schematic perspective view of the microstructure in FIG. 9A.
Figure 9D:
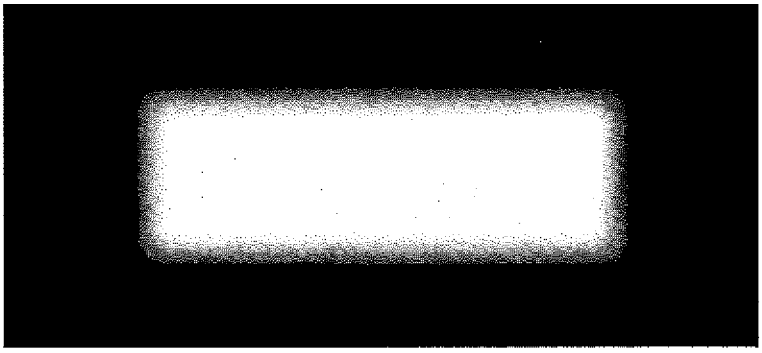
FIG. 9D schematically shows the particular light pattern produced by the surface-structured diffusion plate in FIG. 9B.
Figure 10A:
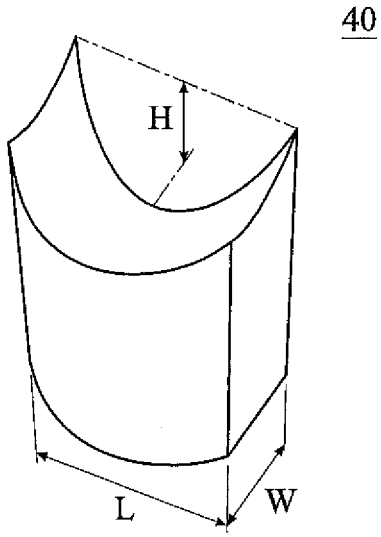
FIG. 10A schematically shows a microstructure in yet another embodiment of the present invention.
Figure 10B:
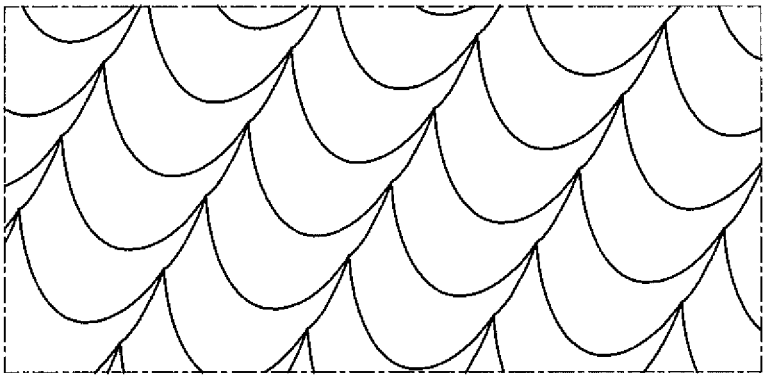
FIG. 10B schematically shows a surface-structured diffusion plate composed of a plurality of microstructures as depicted in FIG. 10A.
Figure 10C:
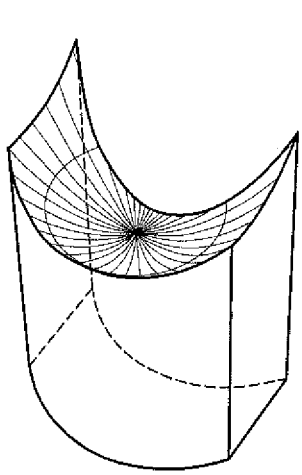
FIG. 10C is a schematic perspective view of the microstructure in FIG. 10A.
Figure 10D:
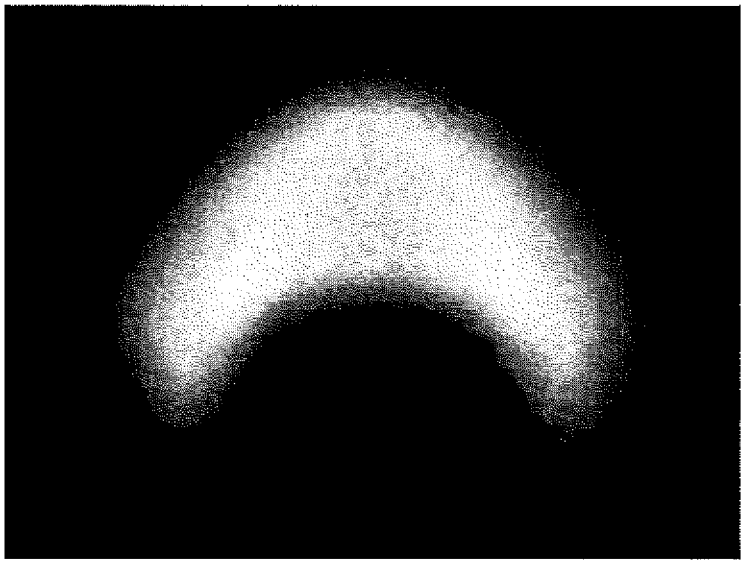
FIG. 10D schematically shows the particular light pattern produced by the surface-structured diffusion plate in FIG. 10B.
Figure 11A:
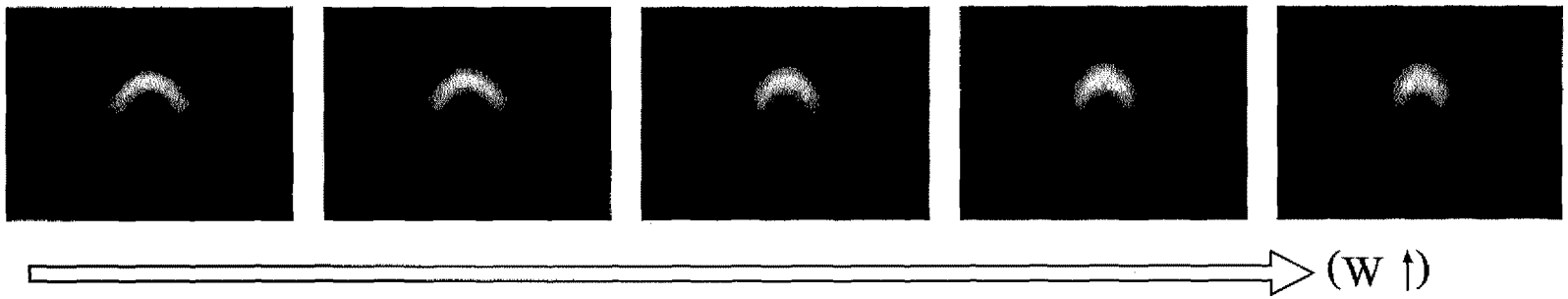
FIG. 11A schematically shows how the particular light pattern produced by a surface-structured diffusion plate composed of a plurality of microstructures as depicted in FIG. 10A changes with the width of each microstructure.
Figure 11B:
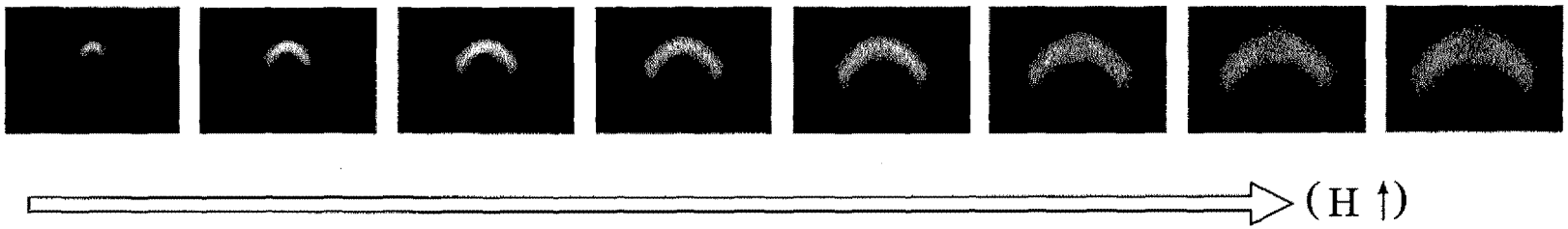
FIG. 11B schematically shows how the particular light pattern produced by a surface-structured diffusion plate composed of a plurality of microstructures as depicted in FIG. 10A changes with the depth of each microstructure.

In other words, when used to illuminate a curvy road section, as shown FIG. 7B, the lamp structure 100 of an adaptive streetlight can produce a light pattern 200 that suits the curvature of the road section to enhance illuminance on the road surface and consequently road users' safety while saving both resources and power.

FIG. 8A through FIG. 8D, FIG. 9A through FIG. 9D, and FIG. 10A through FIG. 10D show another three different microstructures 40 and the square light pattern, rectangular light pattern, and curved light pattern produced by surface-structured diffusion plates 30 having those different microstructures 40 respectively.

In the embodiment shown in FIG. 10A to FIG. 10D, and FIG. 11A to FIG. 11B, wherein the light pattern 200 is a curved light pattern, increasing the width W of each microstructure 40 (indicated by the arrow in FIG. 11A) shortens and thickens the curved light pattern, and increasing the depth H of each microstructure 40 (indicated by the arrow in FIG. 11B) elongates and thickens the curved light pattern. This also helps to show that different light patterns can be produced by only replacing different surface-structured diffusion plates 30 according to practical needs.

This further demonstrates that the light pattern 200 of the lamp structure 100 of an adaptive streetlight can be modified by choosing the desired microstructures 40 for the surface-structured diffusion plate 30. By changing the shape of the microstructures 40, a light pattern suitable for the intended application can be obtained. Thus, not only can the lamp structure 100 of an adaptive streetlight effectively concentrate, confine, and evenly project the light of the streetlight to the target area, but also the microstructures 40 can be modified to effectively control the light output angle according to the shape of the road to be illuminated, in order to produce a particular light pattern 200 that conforms to the shape of the road.

Figure 12A:
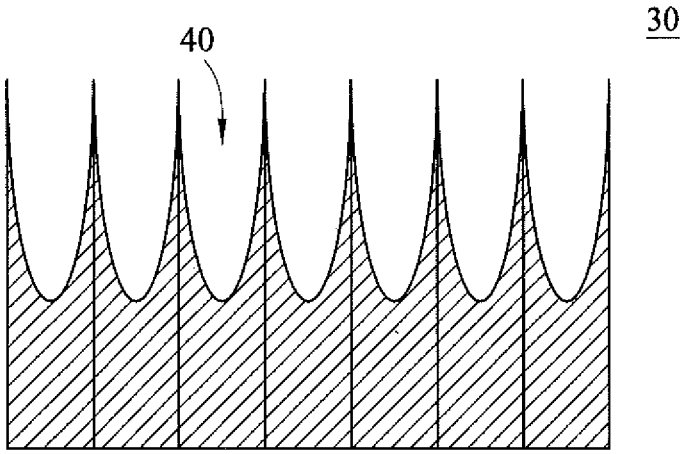
FIG. 12A is a side sectional view of the surface-structured diffusion plate in an embodiment of the present invention.
Figure 12B:
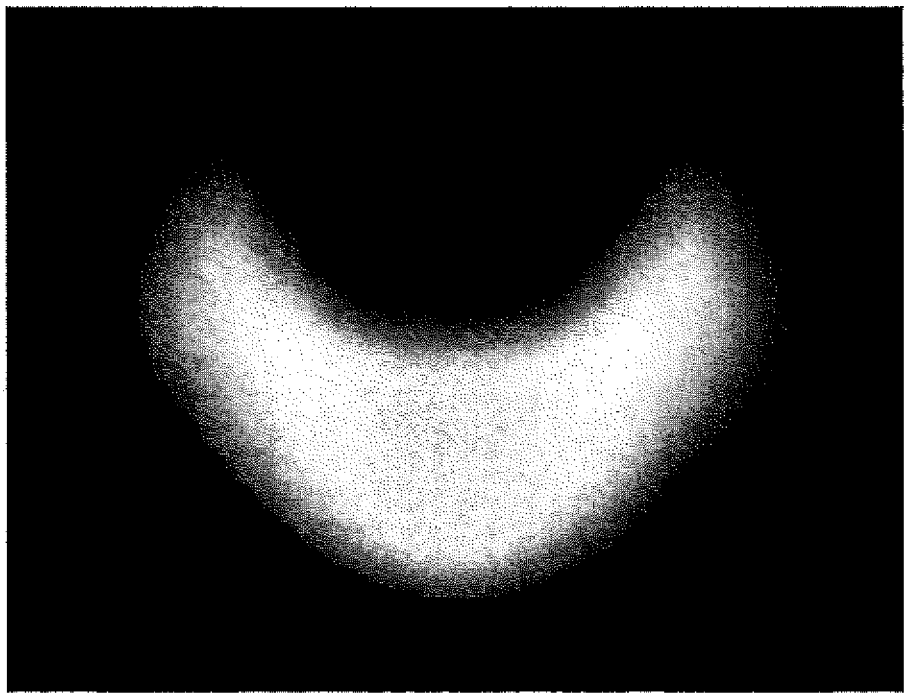
FIG. 12B schematically shows the particular light pattern produced by the surface-structured diffusion plate in FIG. 12A.

FIG. 12A and FIG. 12B respectively show a side sectional view of the surface-structured diffusion plate 30 in an embodiment of the present invention and the light pattern produced through the surface-structured diffusion plate. The surface-structured diffusion plate 30 in FIG. 12A is composed of microstructures 40 of the same shape, and the resulting light pattern features a uniform distribution of brightness.

Figure 13A:
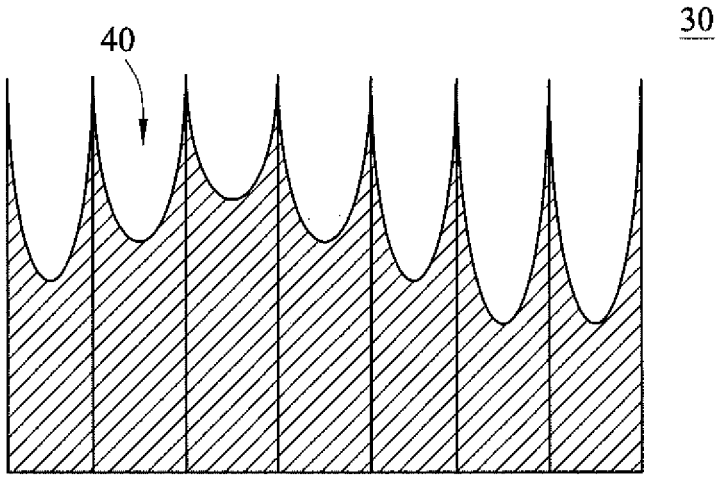
FIG. 13A is a side sectional view of the surface-structured diffusion plate in another embodiment of the present invention.
Figure 13B:
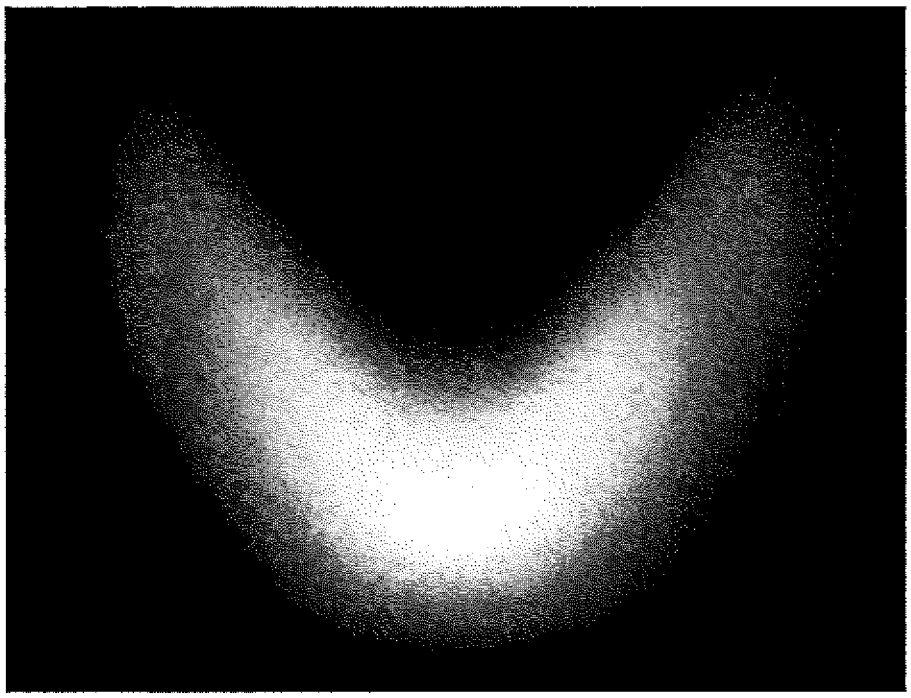
FIG. 13B schematically shows the particular light pattern produced by the surface-structured diffusion plate in FIG. 13A.

In FIG. 13A, at least one of the microstructures 40 is different in shape from the rest of the microstructures 40. Accordingly, referring to FIG. 13B, the light pattern produced through the surface-structured diffusion plate 30 composed of the microstructures 40 in FIG. 13A is less uniform in brightness than that in FIG. 12B. Further, by using microstructures 40 of different structural dimensions to control energy distribution, the modulated light pattern is rendered dimmer in the two end regions than in the middle to facilitate the joining of two different light patterns at adjacent road sections.

Figure 14:
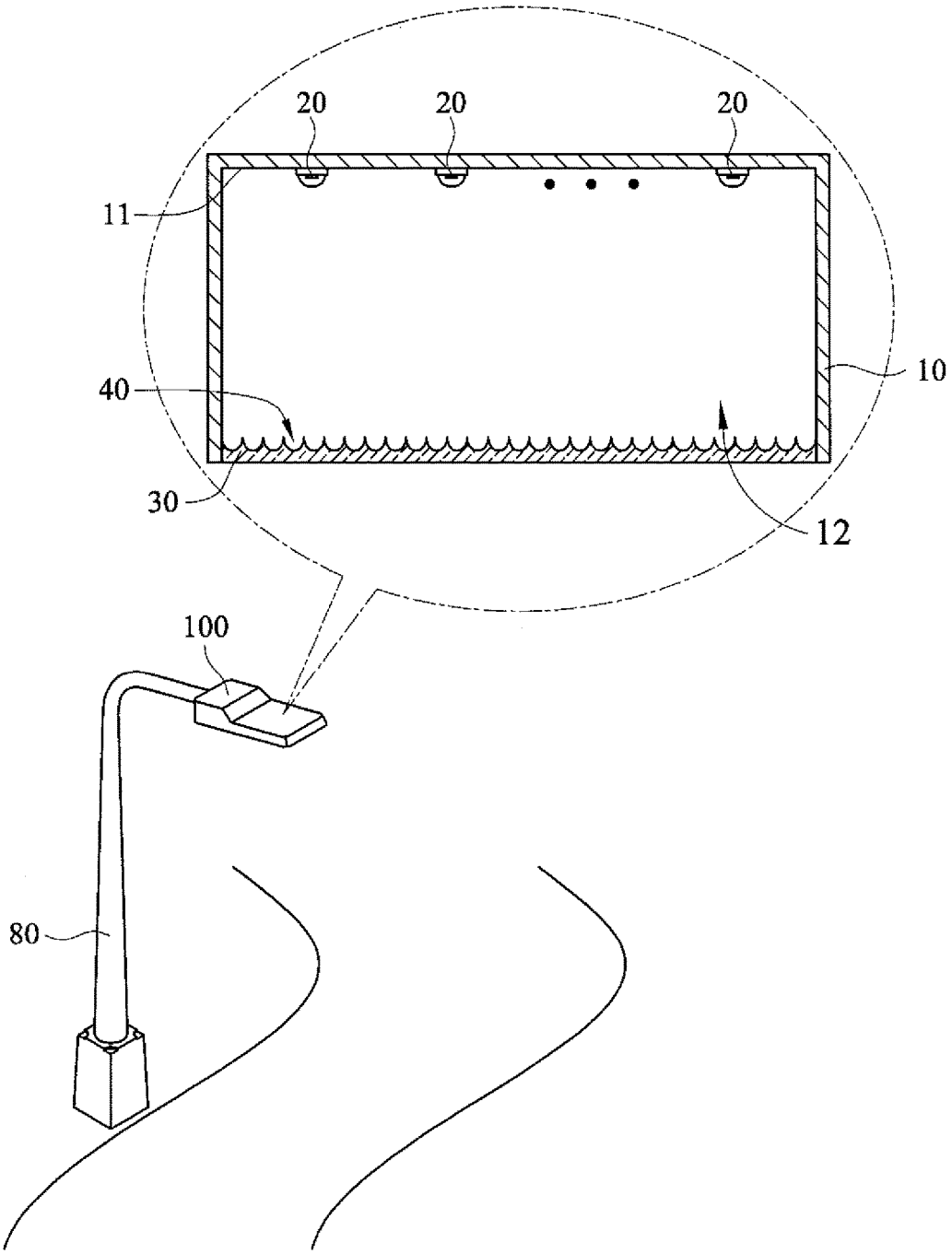
FIG. 14 schematically shows an adaptive streetlight with the lamp structure of the present invention and a lighting support.

Referring to FIG. 14, the lamp structure 100 is fixedly provided on a lighting support 80. The lighting support 80 can be a lighting support configured to stand directly on the ground or to be fixedly provided on the surface of an object. The lighting support 80 also delivers electricity to the lamp structure 100 and allows the light emitted by the lamp structure 100 to be projected in the intended direction.

What is claimed is:

1. A lamp structure of an adaptive streetlight, comprising:

a housing having a bottom surface and an opening:

a plurality of light sources fixedly provided on the bottom surface; and a surface-structured diffusion plate, which is a light-permeable plate connected to the opening and provided with a plurality of microstructures, each said microstructure having a curved or parabolic surface as a light-receiving surface;

wherein at least one of the plurality of microstructures is different in shape from at least another one of the plurality of microstructures, the plurality of microstructures being configured so as to selectively modulate light passing through said diffusion plate and form a predetermined light pattern.

2. The lamp structure of claim 1, wherein each said light source is connected with a light-condensing device, and each said light-condensing device has a projection opening corresponding to the opening.

3. The lamp structure of claim 2, wherein each said light-condensing device collects light emitted by a corresponding said light source and projects the light through the projection opening toward the opening.

4. The lamp structure of claim 2, wherein each said light-condensing device is a condenser lens.

5. The lamp structure of claim 2, wherein each said light-condensing device is a reflector.

6. The lamp structure of claim 1, wherein each said microstructure has a length, a width, and a depth.

7. The lamp structure of claim 1, wherein the plurality of microstructures include a plurality of micro lenses arranged in an array.

8. The lamp structure of claim 6, wherein the length or the width of each of said plurality of microstructures is greater than ten times a wavelength of light emitted by each said light source.

9. The lamp structure of claim 7, wherein the length or the width of each of said plurality of microstructures is greater than ten times a wavelength of light emitted by each said light source.

* * * * *